US008696530B2

(12) United States Patent
Eubanks

(10) Patent No.: US 8,696,530 B2
(45) Date of Patent: Apr. 15, 2014

(54) PORTABLE EXERCISE DEVICE AND SYSTEM FOR USE THEREOF

(76) Inventor: Edward G Eubanks, St. Peters, MO (US)

( * ) Notice: Subject to any disclaimer, the term of this patent is extended or adjusted under 35 U.S.C. 154(b) by 304 days.

(21) Appl. No.: 13/078,183

(22) Filed: Apr. 1, 2011

(65) Prior Publication Data

US 2011/0269608 A1 Nov. 3, 2011

Related U.S. Application Data

(60) Provisional application No. 61/343,398, filed on Apr. 28, 2010.

(51) Int. Cl.
*A63B 21/00* (2006.01)

(52) U.S. Cl.
USPC ..... 482/121; 126/126; 126/904; 126/123

(58) Field of Classification Search
USPC ..... 482/121, 148, 907, 126
See application file for complete search history.

(56) References Cited

U.S. PATENT DOCUMENTS

| | | | | |
|---|---|---|---|---|
| 7,137,925 | B2 * | 11/2006 | Rozycki et al. | 482/51 |
| 7,137,935 | B2 * | 11/2006 | Clarke et al. | 482/123 |
| 7,438,674 | B2 * | 10/2008 | Sjodin | 482/91 |
| 7,651,448 | B2 * | 1/2010 | Hetrick | 482/95 |

* cited by examiner

*Primary Examiner* — Jerome w Donnelly
(74) *Attorney, Agent, or Firm* — Rebecca J. Brandau

(57) ABSTRACT

A portable exercise device includes an elongated base sheet and at least one attachment mechanism secured to the elongated base sheet at preselected locations on one side of said base sheet. The at least one attachment mechanism has at least one apparatus to receive an appendage of a user of the device and to provide a mechanism by which to secure a variety of exercise accessories to the base sheet. A retention mechanism for selectively removably connecting the device to a door sufficiently secures the device to the door that it will permit vigorous repeated use of the device without causing the device to inadvertently separate from the door during use and will also permit rapid, facile removal of the device from the door.

20 Claims, 5 Drawing Sheets

PORTABLE EXERCISE DEVICE AND SYSTEM FOR USE THEREOF

CROSS-REFERENCE TO RELATED APPLICATION

This application relies upon and claims the benefit of the filing date of U.S. Provisional Patent Application Ser. No. 61/343,398, filed Apr. 28, 2010, the entirety of which is incorporated herein by reference.

BACKGROUND OF THE INVENTION

1. Field of the Invention

The present invention relates to portable exercise devices, and, more particularly, to a light-weight, multifunctional exercise device designed to be secured to a door for use as a basis for an exercise system, and which is formed of suitable material for airline travel and which is readily compactable to a size easily transported in a carry-on suitcase.

2. Related Art

Some previous portable exercise devices have been limited in the variety and number of exercises that can be performed with a particular device. Others are limited by the age or physical condition of a potential user of the apparatus. In some cases a light-weight exercise device may nor be sufficiently strong and durable to withstand repeated use by a large or very fit person. Many other known exercise devices are completely unusable by a person who is very young, very old, frail or impeded by any of a number of physical disabilities.

Known exercise devices that are suited for a wide variety of individuals of varying size, fitness and strength generally are stationary and/or very expensive. In some cases, known exercise devices are too complicated or intimidating for many individuals to feel comfortable with even trying to use, much less using regularly. Many such devices also require the use of electricity to function.

SUMMARY OF THE INVENTION

The new exercise device described herein is the first known portable exercise device that is capable of permitting substantially any user to do a large number and wide variety of exercises, while still being very light-weight and highly portable, and while being made of a size and materials that permit it to be passed through airport security and readily carried in conventionally sized carry-on luggage.

The new exercise device requires almost no assembly and is simple and fast to install for use on a conventional door, such as may be found in any residence, hotel or business; so it can be used virtually anywhere. The present device also permits: a) facile removal from a site of use and b) folding or rolling it into a very compact, light-weight unit for portability to an office or hotel room, for example. Further, the new device can be used in a home and left in place, if desired, for further use, while at the same time being very unobtrusive in size and appearance. In fact, the present device is substantially hidden from view from outside the room where it is set up for use.

Accordingly, there has been a long-felt need in the industry for an economically manufactured, light-weight, portable exercise device having the capability of being facilely mounted in a variety of settings. The new device has a very acceptable cosmetic appearance, while still providing the user with the capability of doing a wide variety of highly effective exercises and is highly durable in performance.

A wide variety of applications and features of the present invention will become apparent from the detailed description provided hereinafter. It should be understood that the detailed description and specific examples, while indicating the preferred embodiment of the invention, are intended for purposes of illustration only and are not intended to limit the scope of the invention.

Accordingly, the present invention is, briefly, a portable exercise device, which includes an elongated base sheet and at least one attachment mechanism secured to the elongated base sheet at preselected locations on one side of said base sheet. The at least one attachment mechanism has at least one apparatus to receive an appendage of a user of the device and to provide a mechanism by which to secure a variety of exercise accessories to the base sheet. A retention mechanism for selectively removably connecting the device to a door sufficiently secures the device to the door that it will permit vigorous repeated use of the device without causing the device to inadvertently separate from the door during use and will also permit rapid, facile removal of the device from the door.

The present invention is also briefly, a portable exercise system including the portable exercise device described above in combination with at least one exercise accessory connectable to the portable exercise device by securing the at least one exercise accessory to that at least one attachment mechanism having at least one apparatus to receive an appendage of a user of the device and to provide a mechanism by which to secure a variety of exercise accessories to said base sheet.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

With reference to the attached illustrations, an exercise device, generally designated 10, and useful variations thereof, are described further hereafter. The following description of the preferred embodiment(s) is merely exemplary in nature and is in no way intended 10 limit the invention, its application, or uses.

Figure 1:
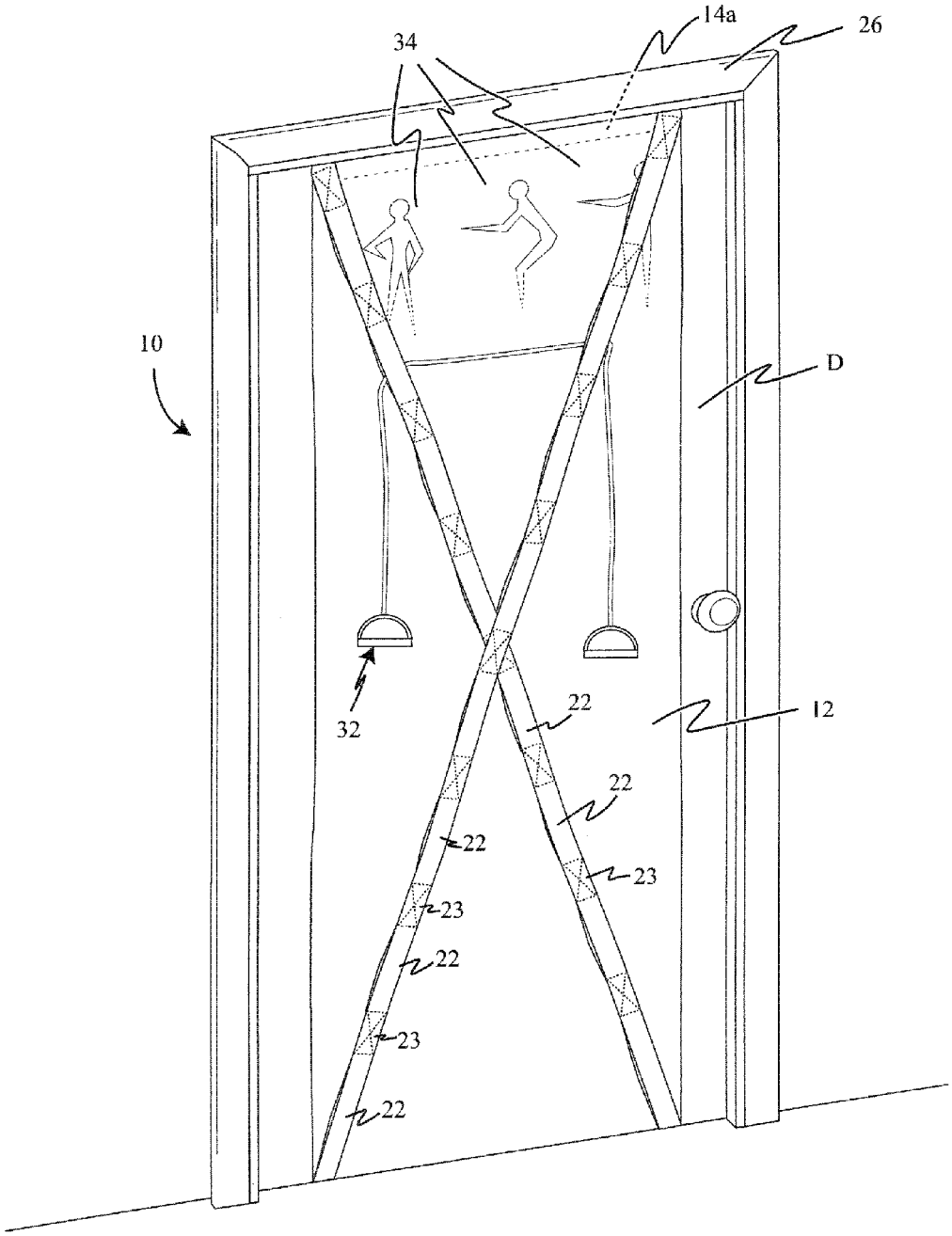
FIG. 1 is a perspective view of one useful embodiment of the device, hung open and secured upon a conventional door, with the user side facing outwardly and showing an example of an optional attachment for use with the new device as an exercise system.
Figure 6:
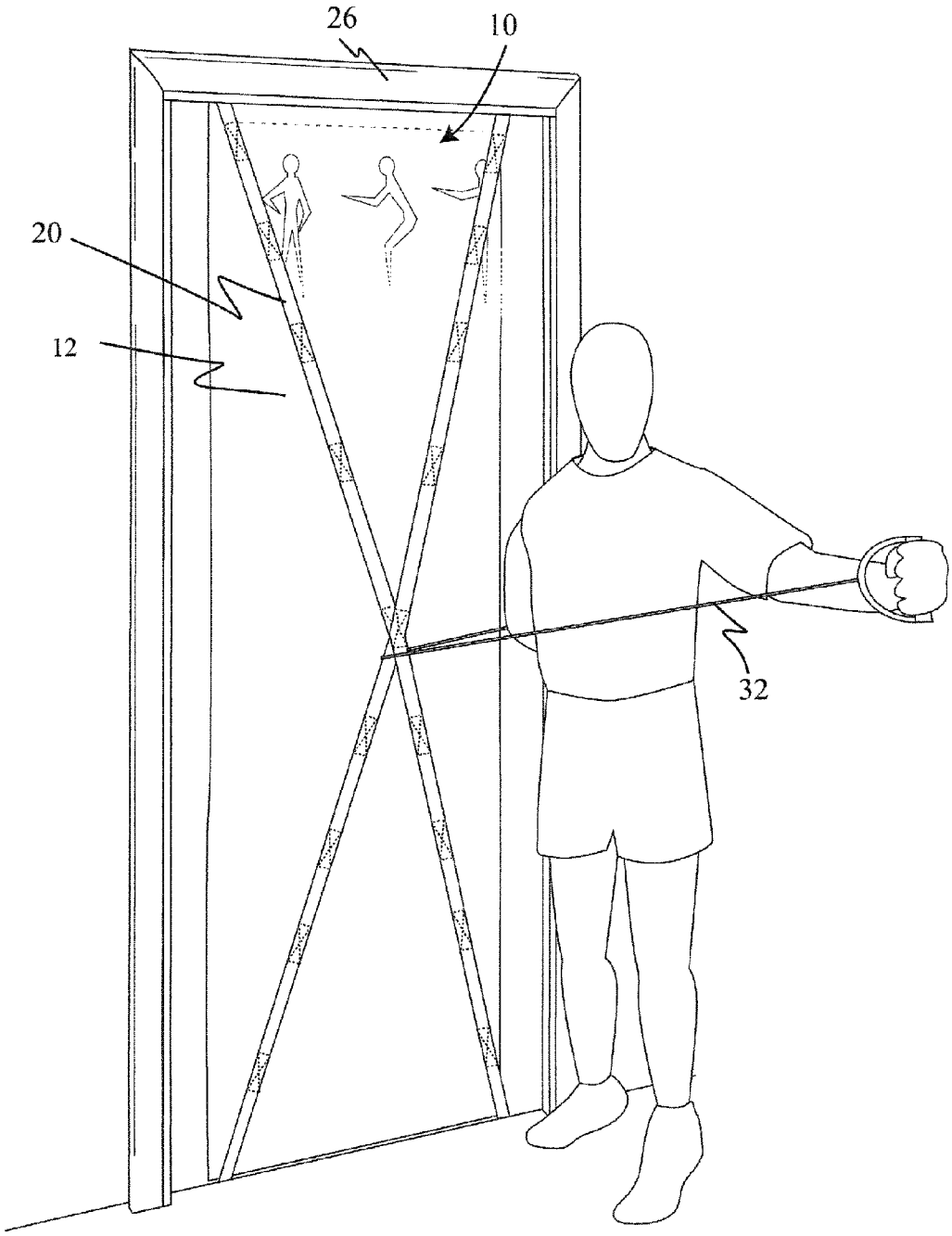
FIG. 6 is a schematic illustration of a person using the new exercise system including the new portable exercise device of FIG. 1 removably attached to a door.

FIG. 1 illustrates portable exercise device 10 in normal use position, removably mounted on a conventional door, the door being closed. Device 10 has an elongated base portion 12 preferably having at each of its two ends a position-retention mechanism 14*a*, 14*b* and strapping 20 which functions to provide multiple places for grasping the device or for selectively attaching accessories to device 10 in order to form an assembly or exercise system. A preferred placement in an X position for strapping 20 is shown in FIGS. 1 and 6. These figures illustrate just one useful configuration of the strapping 20 secured to the elongated fabric base 12 of device 10, although other useful positions can be conceived. Device 10 would certainly be useful with only one section of strapping 20 attached as described, but it is preferred to have at least two sections, as shown. FIG. 1 also shows optional spaces formed beneath strapping 20 and the base sheet 12 thereunder, between areas 23 of strapping which are fixed to the elongated fabric. The preferred method of securely attaching strapping 20 to base sheet 12 at areas 23 is by stitching, but conceivably acceptable securement can be accomplished by other methods, such as by gluing or fixing spaced-apart portions of the strapping to the fabric, as by use of brads or other suitable attachment mechanisms. Stitching is preferred due to the strength that can be provided while being economical, versatile, and not adding significant weight to the finished device 10. Alternatively, although not preferred, sewn-on loops of strapping 20 or other suitable material can be provided, instead of spaces 21. The spaces, indicated for example at 21 in FIG. 1 provide numerous convenient places to serve as a hand-hold (or even a foot-hold) or location to secure other exercise equipment or attachments which facilitate particular exercises. Of course useful combinations of loops and Open, unstitched strap spaces 21 can be conceived and are considered to be part of the present invention.

The sheet which forms the elongated base 12 or support portion of device 10 is preferably formed of a strong webbed or woven material, such as a sturdy nylon sheeting or Gore-tex® fabric. Other pliable sheet-like material may also be acceptable if it is sufficiently strong to withstand the forces applied to it during use without tearing or stretching. Although the useful dimensions of device 10 can vary to some extent, for optimal use the width is preferably approximately 22 inches and the overall length of base sheet 12 is preferably about 92 inches. Portable exercise device 10 has an overall length and width suitable for removably mounting on a standard residential door. Of course, if required, device 10 can be provided in other sizes; for example, to fit an extra high door in an office building or historical home, or a smaller device can be sized to fit on a closet door. It is preferred, however, for transport purposes, that base 12 not be significantly wider than 22 inches, so as to fit readily into a standard carry-on suitcase. Wider versions of course can still be readily portable and acceptably functional although less convenient to pack. Moreover, a convenient carrying strap 28 is secured at the uppermost end (in use) of device 10 and has at least one and preferably two enlarged areas; i.e. integral bumpers 30 to permit use of strap 28 as an extension to secure device 10 at the top of an unusually tall door. Bumpers 30 are sufficiently large to not be capable of being pulled through a normal above-door crack, but nor so large as to be burdensome or unsightly, ideally, strap 28 is about 32 inches long, although a strap somewhat shorter or longer could still be acceptably useful.

In the preferred embodiment illustrated, a substantially tubular, transverse sleeve 14*a*, 14*b* is securely formed, as by rolling and stitching the fabric, for example at each of the opposed ends of the elongated base 12. Sleeves 14*a*, 14*b* are formed with a large enough diameter so that when there is placed within each sleeve a tube, pole or other material to hold the sleeve 14*a*, 14*b* in an expanded state, the upper and lower ends of device 10 can be placed, one each, respectively, on the top and bottom of the door, both on the same side of the door such that when the door is closed the user face of the device is disposed away from the door, on the opposite side from the expanded, sleeved ends of device 10. In this manner, when door D is closed it effectively locks the device in position for use and essentially no amount of pulling on the straps or other equipment attached to the device straps will cause the device to pull away from the closed door. It is advisable to lock the door prior to use of device 10, or the new system, to prevent accidental opening by another person or even by failure of the door latch.

Figure 2:
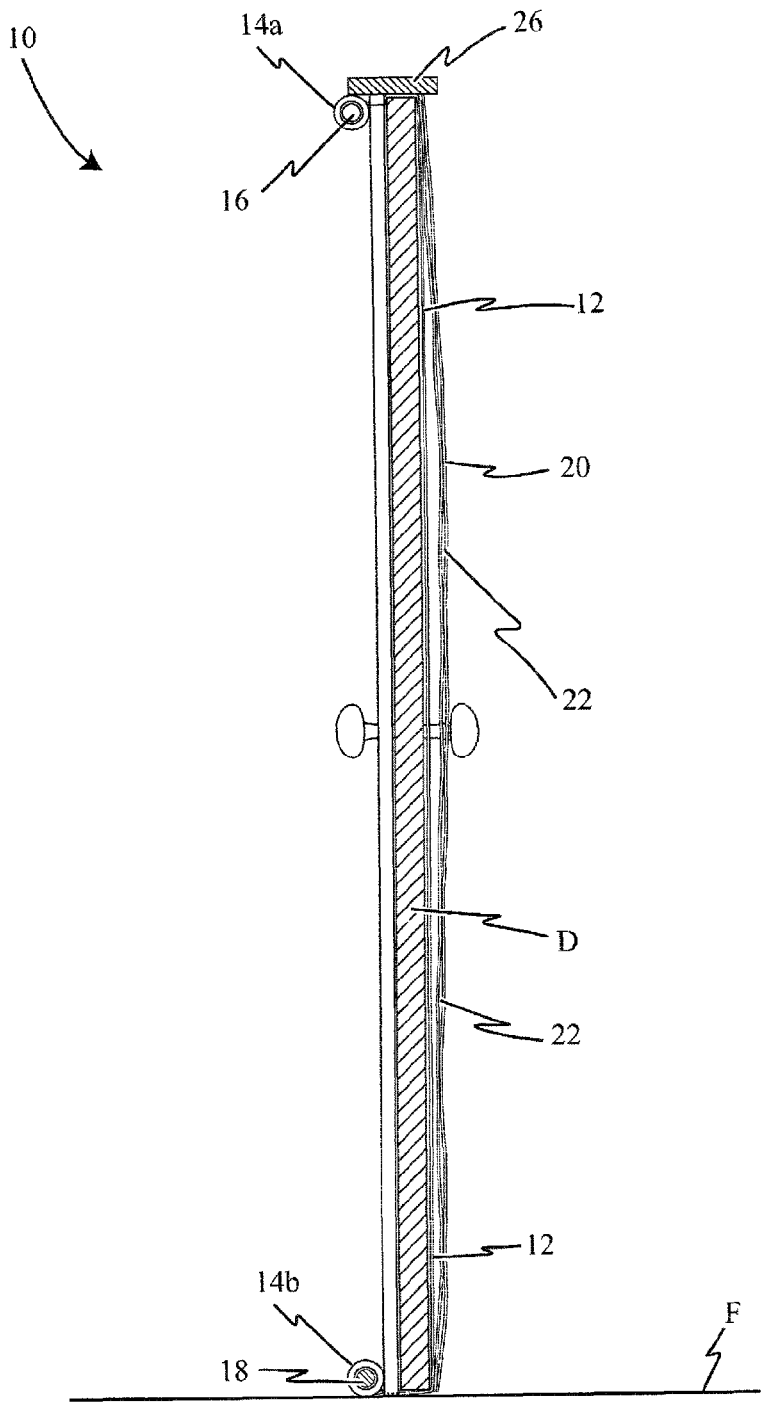
FIG. 2 is a side elevational view of the exercise device of FIG. 1 mounted for use on a door.

FIG. 2 illustrates further the manner in which device 10 is disposed upon one side of a door D and removably but reliably retained in position on the door for use. As previously described, at each end of the elongated base 12 is a preferably, although not necessarily, transverse tubular sleeve 14, shown in cross section in the figure. Within each sleeve 14 is a securing element, such as a plastic pipe length(s), indicated at 16, or a solid rod, as indicated at 18, as an alternative. By positioning the at least partly filled sleeves 14*a*, 14*b* both on the same side of the door, one each at the top and bottom of the door, and then closing the door, device 10 is snuggly and securely, although selectively removably positioned on the door for use. The user is positioned, necessarily, on the side of the door opposite the sleeves 14. Once filled as described, sleeves 14 are sufficiently large in diameter that they cannot be pulled through the space between the top of the door and the upper door frame 26, or through the space between the bottom of the door and the floor F, assuming a conventional distance between the door bottom and the surface of the floor. While device 10 is useful when mounted on either side of a door, it should be understood that the preferred side of the door for mounting is with sheet 12 on the side of the door which faces the trim on the inside of the door frame; i.e. with sleeves 14*a*, 14*b* on the inside of the door. When mounted in this manner the door frame trim acts as further insurance against sleeves 14*a*, 14*h* being able to slip through any space between the top or bottom of the door and the corresponding floor F or upper door frame 26, and the trim prevents the door from opening.

Figure 5:
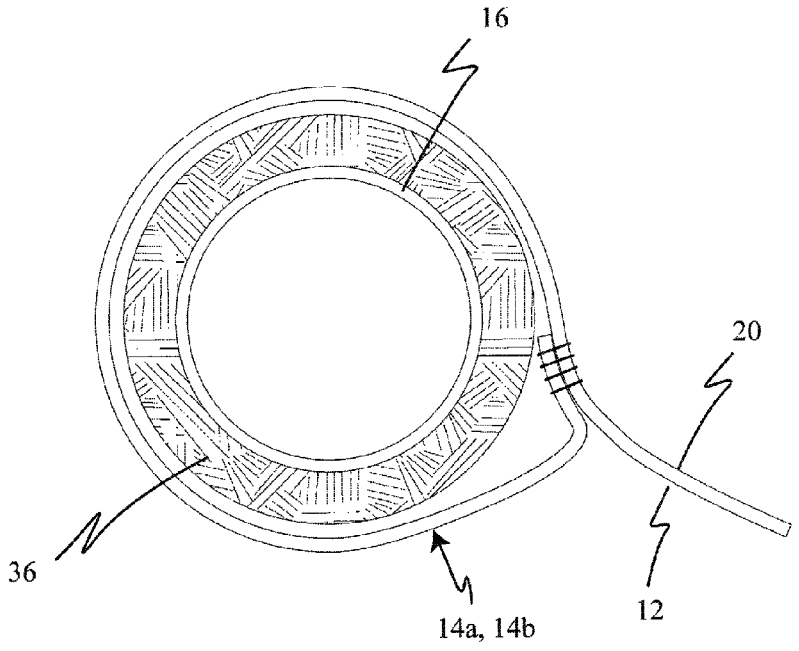
FIG. 5 is a side elevational view of the lower end of the device of FIG. 1, illustrating the mechanism for securing the new portable exercise device to a door.

The door mounting options for exercise device 10 can include, but are not necessarily limited to, securing a length of foam core, plastic tubing, a wooden stick or other suitable object(s) within a sleeve formed at each end of the elongated sheet, transversely to the length of the device. The object within a sleeve 14*a*, 14*b* must necessarily be large enough to fit readily into the sleeve, while at the same time being large enough to prevent the filled sleeve from being pulled through the space above or below the door during the intended use of device 10 for exercise. FIG. 5 further illustrates the preferred construction of the retention mechanisms at each end of device 10. This end view illustrates a short piece (preferably about three inches in length) of hollow rube or pipe 16 which is formed of a lightweight but strong material and is preferably substantially rigid and not more than slightly flexible. A material such as commonly used pvc tubing is ideal, but not necessarily required. Two pieces of rube 16 are used at each end of base sheet 12, with one being positioned coaxially inside each end of a length of foam tubing 36. Foam tubing 36 cushions the retaining mechanism at each end of base sheet 12 and increases the diameter thereof as well. While the size and length of foam tubing 36 may vary, it is preferably approximately as long as the width of base 12 (about 22 inches in the preferred embodiment) and is formed with an interior diameter of about ¾ inch, or approximately the same interior diameter as the exterior diameter of the length of pvc pipe (or rod) at each side of base sheet 12. A wall thickness of about 6/16 of one inch is an example of a useful size suitable for the length of foam tubing 36. Sleeve 14*a*, 14*b* (either one) is also shown in the end view of FIG. 5. Each sleeve is formed, preferably at least one at each end of base 12, by folding or rolling over the ends of base sheet 12 toward the back surface of base 12 and stitching or otherwise securing the previously free edge transversely to the length of base 12. It is preferred that two parallel such sleeves 14 are formed adjacent to each other across at least one of the upper and lower ends of device 10, so as to provide an option as to how long device 10 will be when disposed in the use position on a door. Thus, because there is some variation in door lengths, an extra sleeve, which is preferably provided at the top of device 10 provides the device with a bit more range of use. The extra sleeve, nor in use in FIG. 1, is indicated by the broken line across device 10, just below the upper door frame 26. If desired, at least one additional sleeve 14 can be provided at either or both ends of sheet 12.

Still referring to FIG. 2, on the user facing side of device 10, there are indicated a plurality of portions 22 of strapping 20, which can be raised sufficiently away from base 12 for use as a hand-hold. These raised lengths may instead be sewn-in loops (not shown) or other alternatively formed, but suitably strong securement areas or attachment mechanisms by which the user may either grasp the device by hand, or even by foot, depending upon the exercise. Additionally, the attachment mechanisms 22 of strapping 20 on the user-facing surface of device 10 are conveniently used for attachment to or insertion therethrough of, for example: 1) a carabiner for further assistance in attaching a longer gripping strap, for example, 2) other known types of exercise equipment such as conventional exercise rubber tubing 32 of selectable varying strength, or 3) even strips of rubber sheeting as are commonly used, for example in yoga exercises. Various types of physical therapy devices, such as a hoot, wrist support or neck support, for example, can also be used with device 10, alone or in combination with accessories such as those listed above, merely as examples, as part of the new exercise system, by connecting such accessories or equipment to the device at an optimal location for the particular exercise or physical therapy to be performed.

It should now be apparent that new exercise device 10 is highly adaptable for a wide variety of exercises and for users of virtually any physical type and condition. Multiple known exercises that can be readily managed by use of device 10. To assist the user it is preferred that the user face of base 12 be provided with numerous schematic or other applied figures, such as indicated at 34 on FIG. 1, illustrating the exercise to be performed, for example by attaching a length of rubber rubing 32 or other accessory at a given location on the base 12. These exercises are merely examples and are not intended to limit the uses to which device 10 can be applied.

Figure 4:
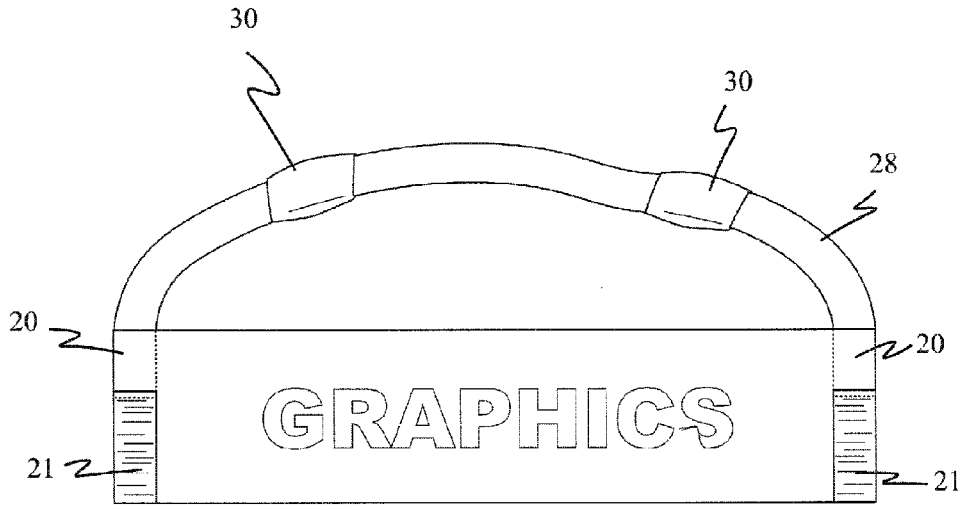
FIG. 4 is a schematic front elevational view of the device of FIG. 1 entirely rolled up for storage or transport and illustrating the carrying strap.

Once positioned where desired for use, as shown in FIGS. 1 and 6, portable exercise device 10 can be left in place on the selected door, or quickly removed and rolled or folded up into a compact, light-weight bundle for storage or travel, as illustrated in FIG. 4. It is further apparent that device 10, being formed preferably substantially entirely of pliable non-metallic material can readily be folded or rolled up rightly into a compact bundle for carrying or packing into a carry-on suitcase, duffel bag, hack pack or other package. The size when folded or rolled for carrying fits easily into a standard carry-on bag for air travel. Further, if device 10 is to be shipped in a container somewhat smaller than a standard carry-on bag, there is sufficient flexibility provided in the rolled-up position, due to the preferred materials and construction, to permit facile bending of the rolled device to fit the smaller container.

Figure 3:
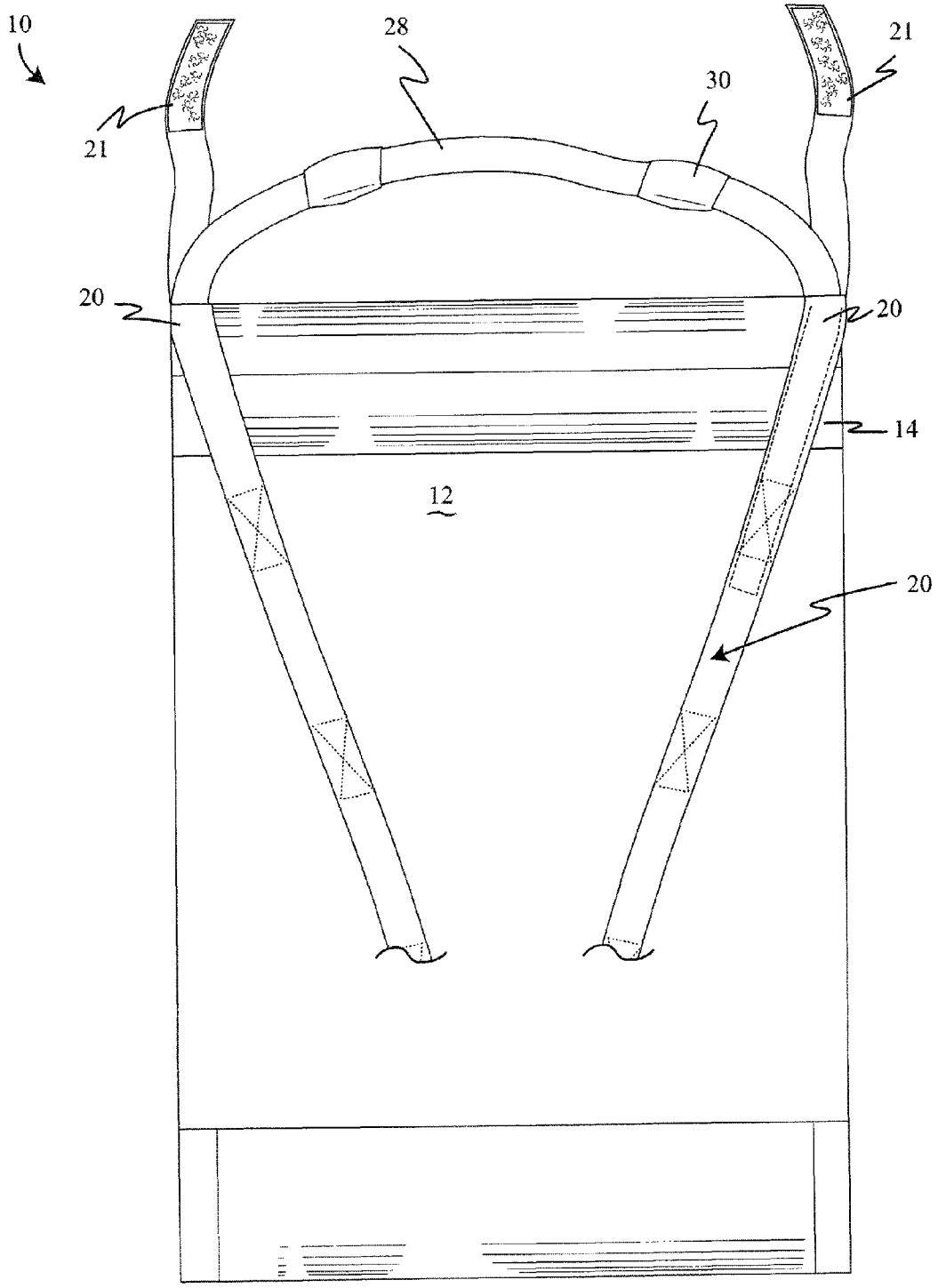
FIG. 3 is a plan view of the device of FIG. 1, partially rolled up.

FIGS. 3 and 4 illustrate a preferred construction with hook and loop fastener strips 21 connected at the upper end of base 12, preferably adjacent to or directly attached to the upper ends of strapping 20 such that when device 10 is compactly rolled up, as illustrated in FIG. 4, the hook and loop fastener strips 21 can be wrapped around the sides of rolled base 12 and secured. In an alternative conformation (not shown), an optional carrying strap is attached to one side of device 10 and positioned so that when base portion 12 is rolled up the carrying strap can be wrapped around the roll and secured, preferably by strips of known hook and loop fasteners. Of course other tying mechanisms or attachments will be apparent that are also suitable to keep the roll in carrying form, but the first-described construction just above is preferred. FIG. 4 also illustrates that when device 10 is rolled or folded up for carrying there is ample space on the outward facing fabric of the device to accommodate text or illustrations, such as a brand name.

While a heavy duty nylon, or other tough synthetic fabric is preferred for use as the base sheet 12, other fabric materials may exist or are yet to be developed, that will certainly suffice for use in device 10, presuming that such other materials are relatively light weight to carry, as compared, for example to a heavier fabric, such a cotton "duck", and also presuming that the fabric is sturdy enough to resist tearing under the forces applied by the user during a vigorous work out using the strap handle members 20 of device 10 to support a portion of the user's body weight as well as the force of pulling against the strap during certain exercises. Of course device 10 can be manufactured from a base fabric and strap material in any number of sizes, colors and designs, as may suit an individual user, although the preferred dimensions are provided above.

It should be apparent that portable exercise device 10 is a lightweight, handy and convenient exercise device which can be available to many users as being economical and suitable for persons of virtually any size, shape or condition. Moreover, device 10 provides the basis of a new exercise system that is highly adaptable to essentially any person wishing to make use of it. The variety of exercises that can be, performed using device 10 alone and/or in combination with other simple equipment is substantially limitless. Some of the exercises that can be readily performed with this system, and, if desired, accomplished in a very short amount of time, include (but are not limited to) known exercises referred to as: crunches, torso twists, cable side bends, woodchopping, rowing, incline chest presses, chest flys, lateral pull-downs, shoulder presses, overhead tricep extensions, bicep curls, tricep extensions, forearm curls, arm circles, back extensions, shoulder presses, rear deltoid flys, calf presses, squats, hip abduction, and walking with resistance. This is just a limited sampling of many exercises that can be readily and properly performed with device 10. A completely inexperienced individual as well as an expert physical trainer can, if desired, even get a thorough work-out in even a very short time period, such as one minute, and can selectively exercise effectively nearly every major muscle group in the body. Portable exercise device 10 can be provided for sale as a convenient package with suitable instructions for many of the exercises that can be performed with the device. Alternatively, or in addition, the consumer can be provided, for example, with a website or other sources for training on various exercises to be performed using the new device and system.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A portable exercise device (10) comprising:

a base sheet (12) having a length approximately that of a standard-sized door;

at least one flexible attachment mechanism (20) non-removably fixed to said base sheet at multiple preselected locations on one side of said base sheet, the at least one attachment mechanism (20) having at least one apparatus (22) to receive an appendage of a user of the device and to provide a mechanism by which to secure a variety of exercise accessories to said base sheet; and a retention mechanism (14*a*,14*b*) for selectively removably connecting the device to a door in such manner that the device is sufficiently secured to the door that it will permit vigorous repeated use of the device without causing the device to inadvertently separate from the door during use and as will also permit rapid, facile removal of the device from the door;

to thereby permit use of said system for a wide variety of exercises and by different users having a wide variety of body types.

2. The portable exercise device of claim 1, wherein said at least one flexible attachment mechanism (20) comprises at least one non-stretchable strap non-removably fixed to a preselected position on one side of said base sheet.

3. The portable exercise device of claim 2, wherein the at least one non-stretchable strap is two non-stretchable straps non-removably fixed to said base in an X formation and extending from one end of said base sheet to the other opposed end thereof.

4. The portable exercise device of claim 2, wherein the at least one non-stretchable strap is non-removably fixed along substantially the entire length thereof to said base sheet except at an at least one certain predetermined section (22); and further wherein said apparatus to receive an appendage of a user and to provide a mechanism by which to secure a variety of exercise accessories to said base sheet comprises the at least one section of strap which is unattached and a space defined between the base sheet and the at least one section of the strap which is unattached, to thereby facilitate the performance of a variety of different exercises by a user of the device.

5. The portable exercise device of claim 3, wherein the two non-stretchable straps are secured along substantially the entire lengths thereof to said base sheet except at certain predetermined sections; and further wherein said apparatus to receive an appendage of a user and to provide a mechanism by which to secure a variety of exercise accessories to said base sheet comprise the sections (22) of strap which are unattached and a space defined between said base sheet and the section of the strap which is unattached, to thereby facilitate the performance of a wide array of different exercises as may be desired by the user.

6. The portable exercise device of claim 2, wherein the at least one non-stretchable strap is secured along substantially the entire length thereof to said base sheet to thereby render the strap to be non-removably fixed to said base sheet, and the apparatus to receive an appendage of a user of the device and to provide a mechanism by which to secure a variety of exercise accessories to said base sheet comprises at least one loop connected to the at least one strap, to thereby facilitate the performance of a variety of different exercises by a user of the device.

7. The portable exercise device of claim 3, wherein the apparatus to receive an appendage of a user of the device and to provide a mechanism by which to secure a variety of exercise accessories comprises a plurality of loops of non-stretchable material fixed to the device at preselected spaced apart positions along the extent of the two non-stretchable straps, to provide the user with an array of possible gripping positions and sites at which to attach other exercise accessories to facilitate performing a wide array of different exercises as may be desired by the user.

8. The portable exercise device of claim 1, wherein said retention mechanism comprises at least one transverse sleeve formed at each of two opposing ends of said base, and at least one insertion member for insertion into a corresponding sleeve, to thereby hold open the diameter dimension of the sleeve so as to prevent release of said base from a door when disposed on a closed door in operative position for an exercising user.

9. The portable exercise device of claim 8, wherein the at least one insertion member comprises a length of foam tubing.

10. The portable exercise device of claim 9, and further comprising a rigid member disposed within each end of the length of foam tubing to provide support to the retention mechanism within the at least one sleeve at each of the two opposing ends of said base sheet.

11. The portable exercise device of claim 8, and further comprising at least a second transverse sleeve at the upper end of said base sheet, the at least a second transverse sleeve being disposed parallel to the at least one transverse sleeve at the upper end of said base sheet and upwardly there from, so as to provide a mechanism for retaining the portable exercise device on a door which is slightly longer than a standard length door.

12. The portable exercise device of claim 1, and further comprising a strap (28) which is secured at each of the two ends thereof on opposed sides of the upper end of said base sheet when the portable exercise device is disposed in normal use position, and extending for use as a carrying strap when the portable exercise device is rolled into a cylindrical shape for transport.

13. The portable exercise device of claim 12, wherein the strap has at least one bumper (30) to thereby prevent the strap from slipping through a space between a door upon which the portable exercise device is mounted and an upper frame around the door, so that the portable exercise device can be operatively mounted upon an especially long door.

14. A portable exercise system comprising:

a portable exercise device (10) having a base sheet (12) having a length approximately that of a standard-sized door, at least one attachment mechanism (20) non-removably fixed to said base sheet at preselected locations dispersed along the length of and on one side of said base sheet, the at least one attachment mechanism (20) having at least one apparatus (22) to receive an appendage of a user of the device and to provide a mechanism by which to secure a variety of exercise accessories to said base sheet and a retention mechanism (14,14*b*) for selectively removably connecting the device to a door in such manner that the device is sufficiently secured to the door that it will permit vigorous repeated use of the device without causing the device to inadvertently separate from the door during use and as will also permit rapid, facile removal of the device from the door; and at least one exercise accessory connectable to the portable exercise device by securing the at least one exercise accessory to that at least one attachment mechanism (22) having at least one apparatus to receive an appendage of a user of the device and to provide a mechanism by which to secure a variety of exercise accessories to said base sheet;

to thereby permit use of said system for a wide variety of exercises and by different users having a wide variety of body types.

15. The portable exercise system of claim 14, and further comprising a plurality of exercise accessories which can be interchangeably removably connected to the portable exercise device to permit the user to perform a variety of preselected exercises with said portable exercise device mounted in normal use position upon a door.

16. The portable exercise system of claim 14, and further comprising an instruction manual to facilitate a user learning various exercises and the method for most efficient, effective use of said portable exercise device.

17. The portable exercise system of claim 15, wherein the plurality of exercise accessories includes at least one carabiner to facilitate attachment of other objects to the exercise device.

18. The portable exercise system of claim 15, wherein the plurality of exercise accessories includes at least one length of stretchable tubing to thereby facilitate use of the system to perform particular preselected exercises.

19. The portable exercise system of claim 15, wherein the plurality of exercise accessories includes at least one mechanism for attachment to a user's orthopedic device.

20. The portable exercise system of claim 15, wherein all elements of the system are flexible, light-weight and non-metallic such that the system is thereby readily carried by even small individuals, readily rolled, folded or otherwise formed to fit into luggage, and readily passed through airport security without delay.

* * * * *